US005193228A

United States Patent [19]

Murasawa et al.

[11] Patent Number: 5,193,228

[45] Date of Patent: Mar. 16, 1993

[54] TOILET COVERING HINGE ASSEMBLY WITH DAMPING CAPABILITY

[75] Inventors: Kanzo Murasawa, Toyonaka; Toshiyuki Kakinoki, Yahata; Yukio Yamamura, Hirakata, all of Japan

[73] Assignee: Matsushita Electric Works, Ltd., Osaka, Japan

[21] Appl. No.: 698,221

[22] Filed: May 10, 1991

[51] Int. Cl.[5] ..... A47K 13/12

[52] U.S. Cl. ..... 4/236; 4/240

[58] Field of Search ..... 49/137, 138, 322; 188/307, 322.5, 308, 309, 82.77, 82.2, 306, 82.1; 4/240, 236, 241, 234, 235, 237, 238, 239, 251, 248; 16/319, DIG. 21, DIG. 9, 54, 55, 68, 255, 277, 278, 292, 297, 317; 192/58 R; 475/91, 92, 93; 74/574; 418/154; 91/400, 401; 277/DIG. 9

[56] References Cited

U.S. PATENT DOCUMENTS

| | | | |
|---|---|---|---|
| 1,132,463 | 3/1966 | Wasdell | 188/322.16 |
| 1,820,971 | 3/1929 | Gruenfeldt | 188/306 X |
| 1,942,658 | 4/1928 | Mitchell | 188/309 X |
| 2,026,024 | 9/1934 | Dullere | 4/236 |
| 4,491,989 | 1/1985 | McGrail | 4/251 |
| 4,666,386 | 5/1987 | Winkler et al. | 188/307 X |
| 4,914,757 | 4/1990 | Johnson | 4/251 |
| 5,010,601 | 4/1991 | Kobayashi et al. | 4/236 |

FOREIGN PATENT DOCUMENTS

| | | | |
|---|---|---|---|
| 2-6594 | 1/1990 | Japan . | |
| 9112760 | 9/1991 | World Int. Prop. O. | 4/251 |

*Primary Examiner*—Charles E. Phillips
*Attorney, Agent, or Firm*—Nikaido, Marmelstein, Murray & Oram

[57] ABSTRACT

A toilet covering hinge assembly has a damping capability for damping the motion of the toilet covering from a raised to a lowered position upon a toilet. The assembly includes a hinge shaft connecting the toilet covering to the rear of the toilet so as to be rotatable together with the toilet covering between the lowered and raised positions. Also connected to the hinge shaft is a dashpot which is secured on the side of the toilet and comprises a cylinder containing a volume of damper fluid and a rotor rotatably received within the cylinder. The rotor receives the hinge shaft to be rotatable together therewith and is provided with a flap extending outwardly into the damper fluid. The flap is pivotable relative to the rotor such that the flap is caused to, in response to the toilet covering moving from the lowered to the raised position, pivot into a folded condition where it receives no substantial resistance from the damper fluid and is caused. In response to the toilet covering moving from the raised to the lowered position, the flap pivots into an unfolded condition where it receives increased resistance from the damper fluid for dampening the motion of the toilet covering moving in that direction. The flap is formed to have an integral anchor bulb which is rotatably fitted within a corresponding bearing cavity in the outer surface of the rotor so that the flap is pivotally supported to the rotor without requiring any other supporting structure.

9 Claims, 9 Drawing Sheets

63
60
62
64
61

56
52
53
51
59
59
54
55
50

TOILET COVERING HINGE ASSEMBLY WITH DAMPING CAPABILITY

BACKGROUND OF THE INVENTION

1. Field of the Invention

The present invention is directed to a toilet covering hinge assembly with damping capability, and more particularly to a hinge assembly capable of damping the motion of a toilet seat and/or lid moving from its raised position to a lowered position upon a toilet, yet moving the same with a slight resistance from the lowered position to the raised position.

2. Description of the Prior Art

There has been an increased demand for toilet covering hinge assemblies that damp the motion of the toilet covering, such as a toilet seat and a toilet lid, in order to prevent accidental falling of the toilet covering upon the toilet with an unpleasant loud impact noise. To give such damping capability to the toilet covering, it has been proposed in Japanese Utility Model Early Publication No. 2-6594 (published on Jan. 17, 1990) to utilize a dashpot in combination with a hinge shaft mounting the toilet covering to the rear of a toilet for rotation of the toilet covering between a lowered position and a raised position. The dashpot comprises a cylinder containing a volume of damper fluid such as grease or the like and a rotor rotatably received in the cylinder as being surrounded by the damper fluid. The rotor, which is connected to the hinge shaft to be rotatable together with the toilet covering, includes a plurality of flaps pivotally supported on the rotor. As the toilet covering is rotated upward from the lowered position to the raised position, the flaps are caused to move into a folded condition on the outer surface of the rotor where they receive less resistance from the damper fluid, enabling the toilet covering to be lifted with a slight force by the user. On the other hand, as the toilet covering is manipulated to rotate down from the raised position to the lowered position, the flaps are caused to extend into an unfolded position where they receive increased resistance from the damper fluid, thus dampening the motion the toilet covering moving in that direction. In this assembly, however, the flaps are supported by means of pivot pins to the rotor, which inevitably incurs the increased number of parts with the attendant assembly complexity.

SUMMARY OF THE INVENTION

The above problem has been eliminated in the present invention which provides an improved toilet covering hinge assembly with damping capability. The hinge assembly in accordance with the present invention comprises a hinge shaft connecting a toilet covering to the rear of a toilet so as to be rotatable together with the toilet covering between a lowered and a raised position. Also connected to the hinge shaft is a dashpot which is secured on the side of the toilet and comprises a cylinder containing a volume of damper fluid and a rotor rotatably received within the cylinder. The rotor receives the hinge shaft to be rotatable together therewith and is provided with a flap extending outwardly into the damper fluid. The flap is pivotable relative to the rotor such that the flap is caused to, in response to the toilet covering moving from the lowered to the raised position, pivot into a folded condition where it receives no substantial resistance from the damper fluid. In response to the toilet covering moving from the raised to the lowered position, the flap pivots into an unfolded condition where it receives increased resistance from the damper fluid for dampening the motion of the toilet covering moving in that direction. The flap is formed to have an integral anchor bulb which is rotatably fitted within a corresponding bearing cavity in the outer surface of the rotor so that the flap is pivotally supported to the rotor without requiring any other supporting structure.

Accordingly, it is a primary object of the present invention to provide an improved toilet covering hinge assembly which is capable of damping the motion of the toilet covering moving down from the raised position to the lowered position, yet assuring to simplify the supporting structure of the flap to the rotor with a minimum number of parts.

Preferably, the rotor is formed with a first stopper limiting the pivotal movement of the flap so as to prevent it from further pivoting past the folded condition to lie down on the exterior surface of the rotor during the movement of the toilet covering from the lowered position to the raised position, and is formed with a second stopper projecting on the rotor to support the flap in the unfolded condition during the movement of the toilet covering from the raised position to the lowered position.

It is therefore another object of the present invention to provide an improved toilet covering hinge assembly in which the flap can be kept reliably in both of the folded and unfolded positions.

The flap is molded from a plastic material to have its free end portion in the form of a resilient tongue which is biased into contacting engagement with an interior surface of the cylinder. This is advantageous in eliminating the formation of an undesirable gap between the flap and the interior surface of the cylinder which would otherwise cause variations in the flow resistance during the movement of the toilet covering between the lowered position and the raised position.

It is therefore a further object of the present invention to provide an improved toilet covering hinge assembly which is capable of smoothly moving the toilet covering without causing undue variations in the flow resistance.

Preferably, the cylinder and the rotor defines therebetween a fluid chamber extending over a limited angular range about the hinge axis for receiving the damper fluid such that the flap in the unfolded condition extends into said fluid chamber in such a manner as to divide the fluid chamber into two sections whose volumes are variable as the rotor rotates in response to the movement of the toilet covering between the lowered and the position. Therefore, it is readily possible to progressively increase the resisting force as the toilet covering moves from the raised position to the lowered position in consistent with increasing speeds at which the toilet covering fall down to the lowered position under the influence of gravity.

It is therefore a still further object of the present invention to provide an improved toilet covering hinge assembly which is capable of progressively increasing the resisting forces to move the toilet covering from the raised position down to the lowered position at substantially the uniform rate.

In a preferred embodiment, a pair of concentric hinge shafts are utilized to be connected respectively to a toilet seat and a toilet lid for rotation about a common hinge axis between a lowered and a raised position, respectively. The hinge shafts, each movable together with each of the toilet seat and lid, are connected respectively to a pair of dashpots secured on the side of the toilet in order to damping the motion of the toilet seat and lid. The flap of each dashpot is formed with at least one through-hole permitting the damper fluid to flow therethrough for adjusting resistance which the flap receives from the damper fluid. The two dashpots are configured to have the different number and/or location of the through-holes in the flap from one another so as to give different resisting forces to the motion of the toilet seat from that of the toilet lid in compensation for differing weights of the toilet seat and lid, enabling to move the toilet seat and lid at substantially the same rate from the raised position to the lowered position.

It is therefore a further object of the present invention to provide an improved toilet covering hinge assembly which is capable of rotating the toilet seat and lid of different weights at substantially the same rate from the raised position to the lowered position.

Independently or in combination with the above feature of differentiating the number or location of through-holes in the respective flaps, the dashpots may contain the damper fluid of different viscosity to give different resistance to the motion of the toilet seat from that of the toilet lid for equalizing the rotating rate at which the toilet seat and lid move down to the lowered position.

The cylinder is formed on its interior surface with a cam projection on which the free end of the flap in the unfolded condition rides when the toilet covering moves into the raised position. The cam projection is configured to engage with only a portion of the flap so as to leave between the remaining portion of the flap and the interior surface of the cylinder a clearance through which the damper fluid is permitted to flow. With this arrangement, the toilet covering is allowed to move with greatly reduced resistance for a limited travel distance of the toilet covering from the raised position during which the flap is kept engaged with the cam projection, after which it receives increased resistance to slowly move the toilet covering down to the lowered position.

It is therefore a further object of the present invention to provide an improved toilet covering hinge assembly which is capable of assuring to the ability of the toilet covering to move without applying any unduly large amounts of force.

The rotor is formed therearound with an outer flange at one axial end spaced from the flap in an axial direction of the rotor for rolling contact with a ball which is supported on the cylinder to rotate at a fixed location. The ball is spring biased into a stop recess formed in the outer flange when the toilet covering comes into the raised position for latching the toilet covering into that position.

It is therefore a further object of the present invention to provide an improved toilet covering hinge assembly which is capable of retaining the toilet covering at the raised position in order to prevent unexpected movement of the toilet covering from the raised position down to the lowered position.

Preferably, the outer flange is formed to further include an arcuate guide recess along which the ball is guided as the toilet covering rotates from the lowered position to a position immediately ahead of the raised position. The guide recess is formed at its one end adjacent to the stop recess with a moderately sloped edge so as to smoothly move the ball out of the guide recess into the stop recess.

It is therefore a still further object of the present invention to provide an improved toilet covering hinge assembly which is capable of smoothly moving the toilet covering into and latching the same into the raised position.

These and still other objects and advantages will become more apparent from the following detailed description of the embodiment when taken in conjunction with the attached drawings.

BRIEF DESCRIPTION OF THE DRAWINGS

FIG. 22 is a horizontal section similar to FIG. 21 but shows a modification of the above embodiment.

DETAILED DESCRIPTION OF THE EMBODIMENT

Figure 1:
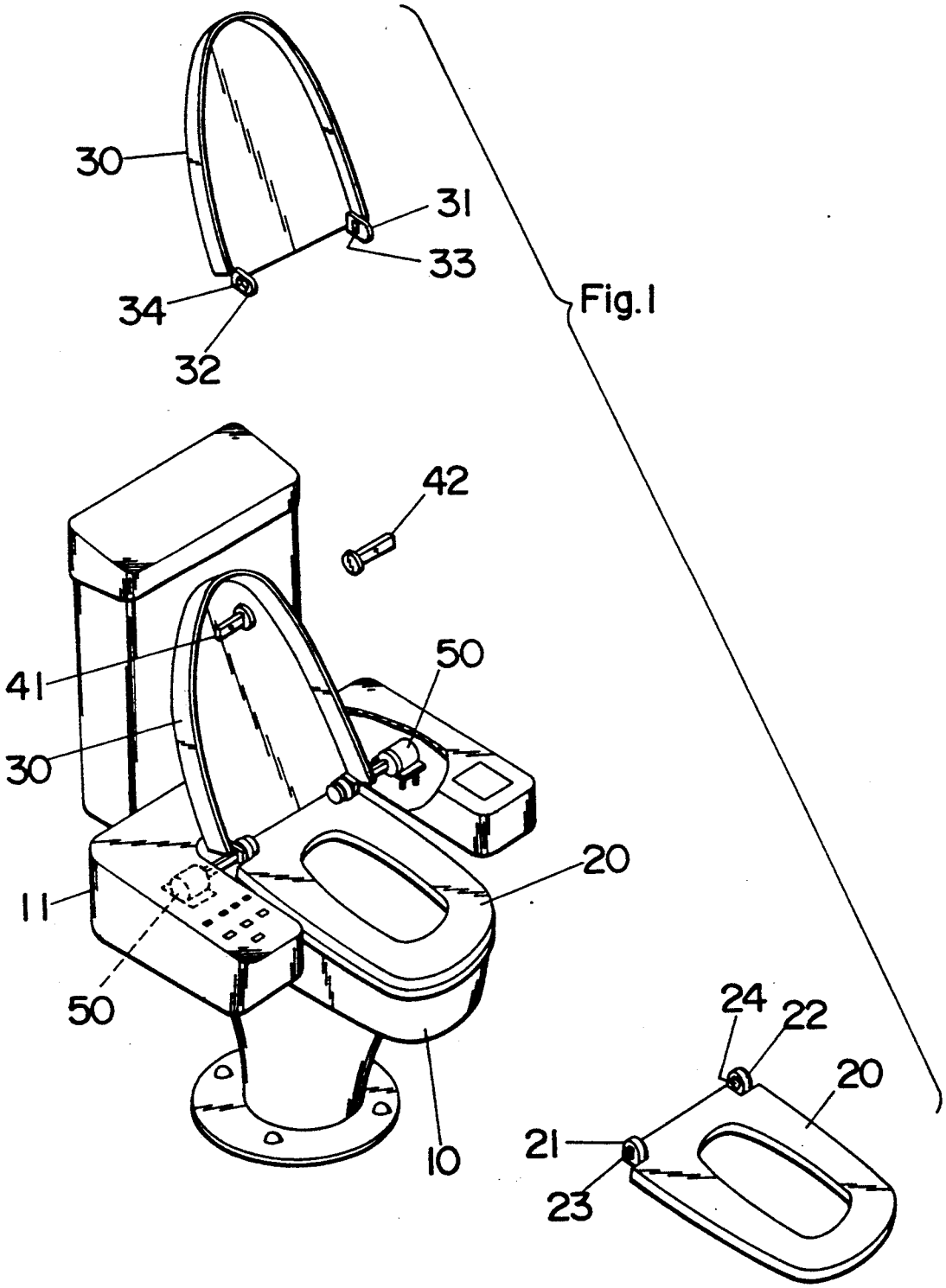
FIG. 1 is a perspective view of a toilet incorporating a toilet covering hinge assembly in accordance with a preferred embodiment of the present invention.

Referring now to FIG. 1, there is shown a toilet incorporating a toilet covering hinge assembly in accordance with the present invention. The assembly includes a toilet seat 20 and a toilet lid 30 which are mounted to the rear end of a toilet bowl 10 for rotation about a hinge axis between a lowered position on the toilet bowl 10 and a raised position. The toilet seat 20 and the toilet lid 30 can be collectively referred to as a toilet covering [and are frequently so referred to in the specification]. A pair of hinge shafts 41 and 42 are provided in a horizontally spaced relation to connect the lateral sides of the toilet seat 20 and lid 30 to the toilet bowl 10 and define the hinge axis about which the seat 20 and lid 30 rotate. The seat 20 and the lid 30 are each formed on its rear end with a pair of laterally spaced brackets 21, 31 and 22, 32 through which the hinge shafts 41 and 42 extend respectively. Each of the brackets 21 and 31, Which are formed on the seat 20 and the lid 30 in opposing relation with respect to the lateral, direction along the hinge axis, is formed to have segmented circle shaped holes 23, 33 with rounded ends, while each of the other brackets 22 and 32 is formed to have a round hole 24, 34. Each of the hinge shafts 41 and 42 has its shank with an I-shaped cross-section in conformity with the hole 23, 33 so that it is tightly fitted the I-shaped hole 23, 33 but loosely fitted in the round hole 24, 34. Thus, the shaft 41 is rotatable together with the toilet seat 20 but not with the lid 30, while the shaft 42 is rotatable together with the lid 30 but not with the seat 20.

Figure 2:
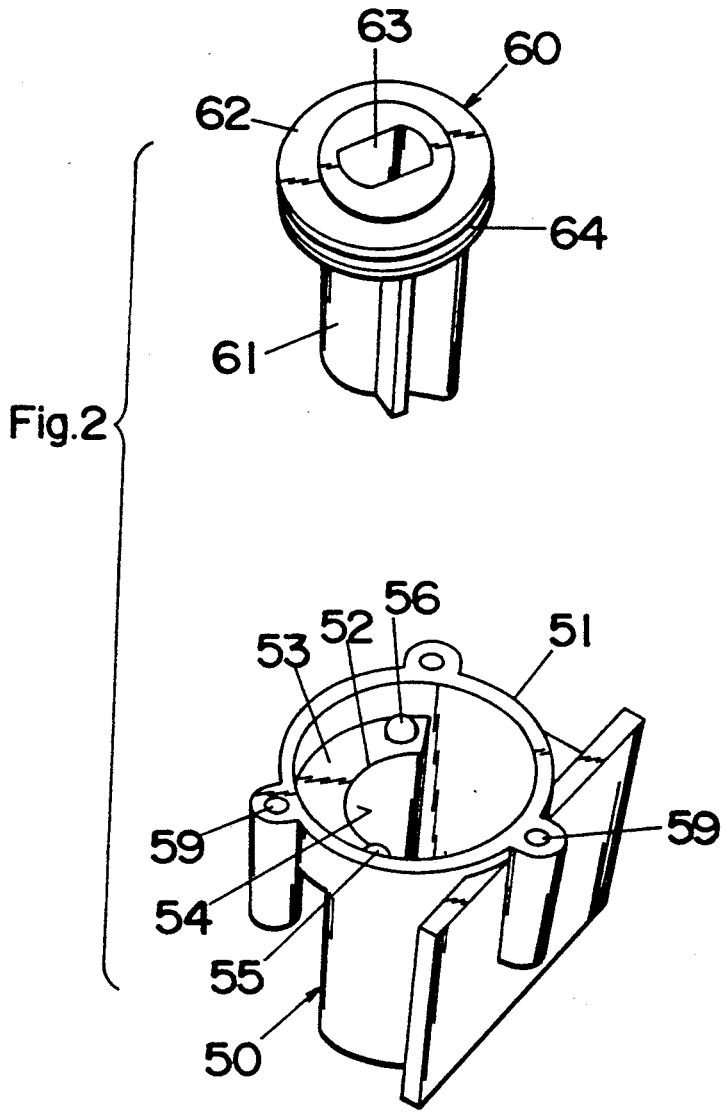
FIG. 2 is an exploded perspective view of a dashpot constituting the above hinge assembly.
Figure 3:
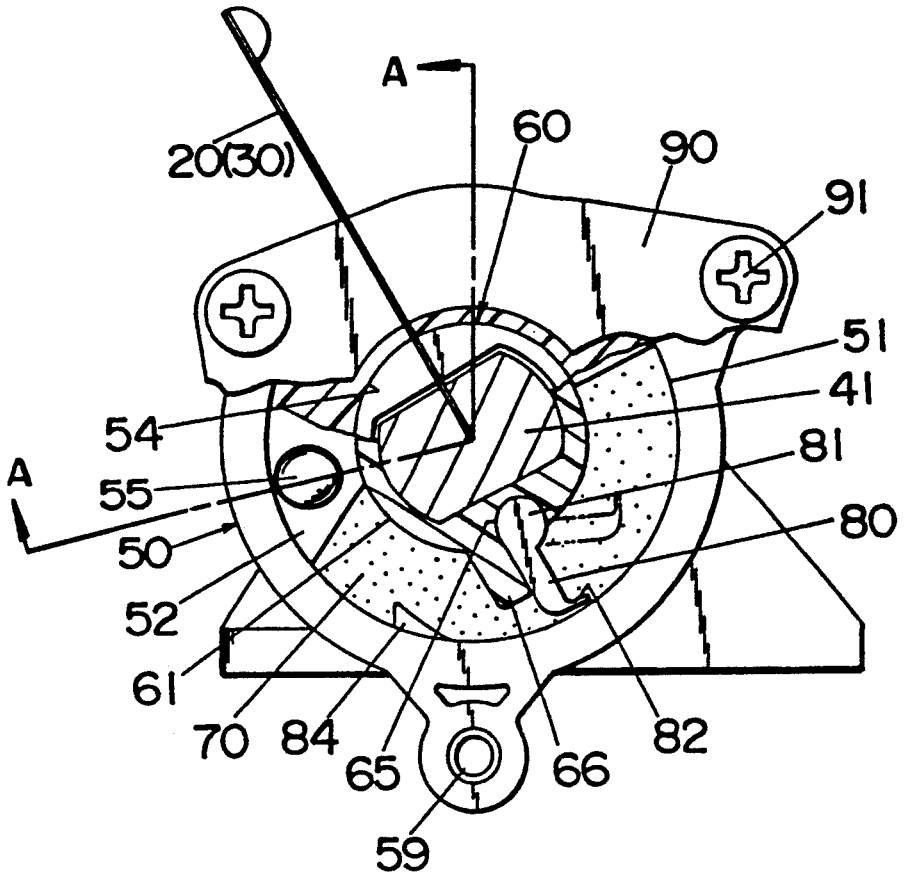
FIG. 3 is a horizontal sectional view, partly shown in top view, illustrating the operation of the hinge assembly.
Figure 4:
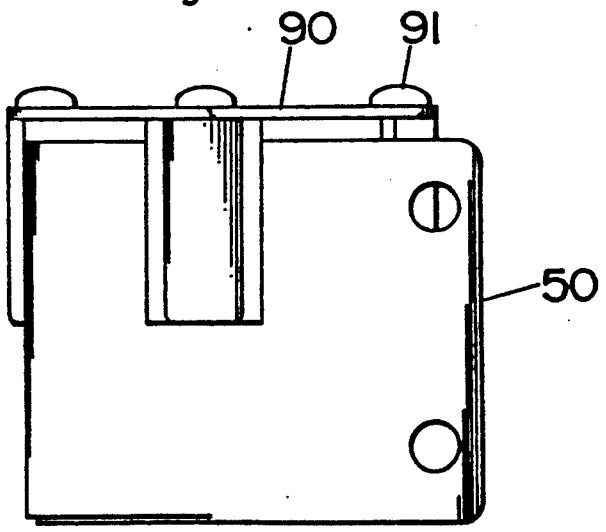
FIG. 4 is a front view of the dashpot.
Figure 5:
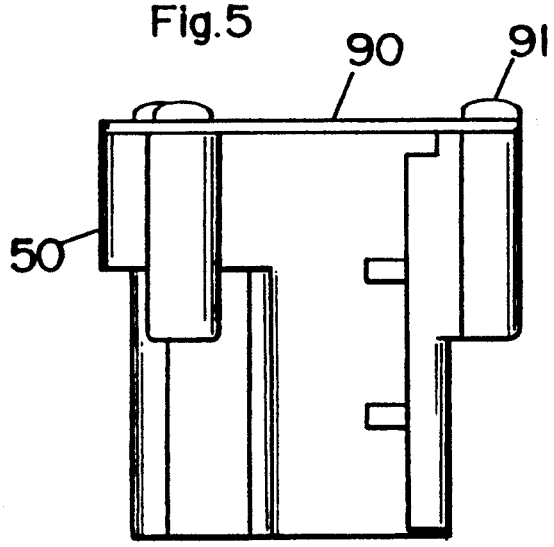
FIG. 5 is a left side view of the dashpot.
Figure 6:
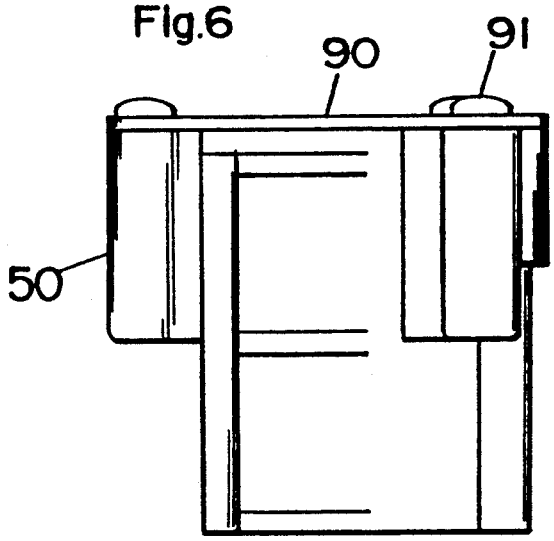
FIG. 6 is a right side view of the dashpot.
Figure 7:
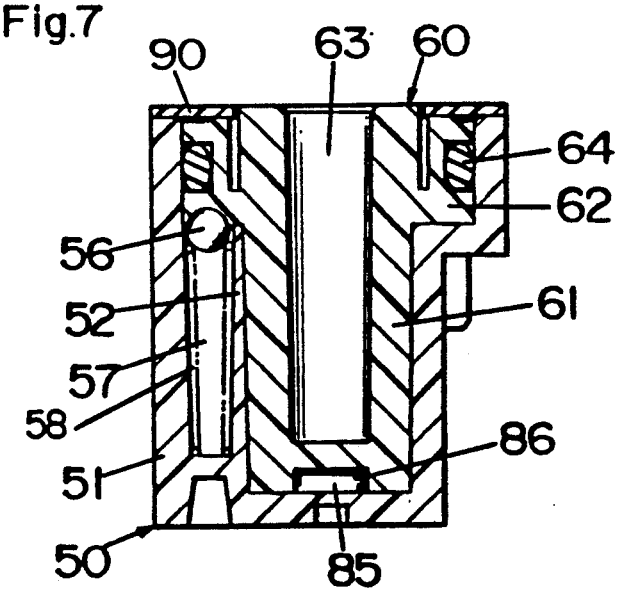
FIG. 7 is a vertical section taken along line A—A of FIG. 3.
Figure 8:
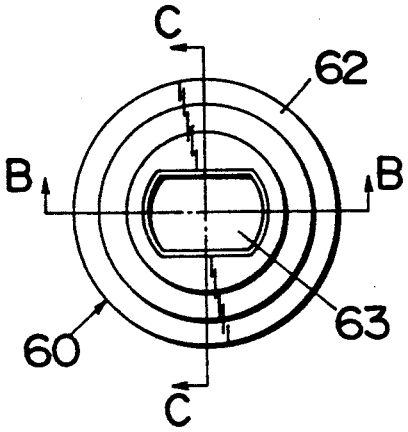
FIG. 8 is a top view of a rotor consisting the dashpot.
Figure 10:
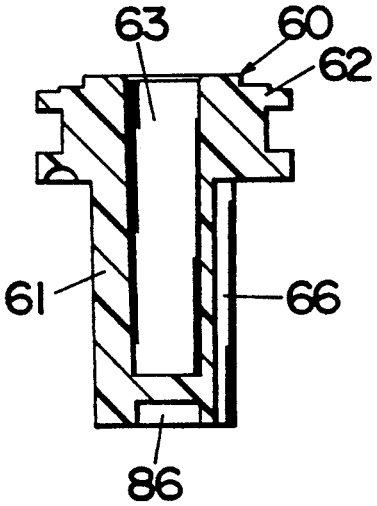
FIG. 10 is a vertical section taken along line C—C of FIG. 8.
Figure 9:
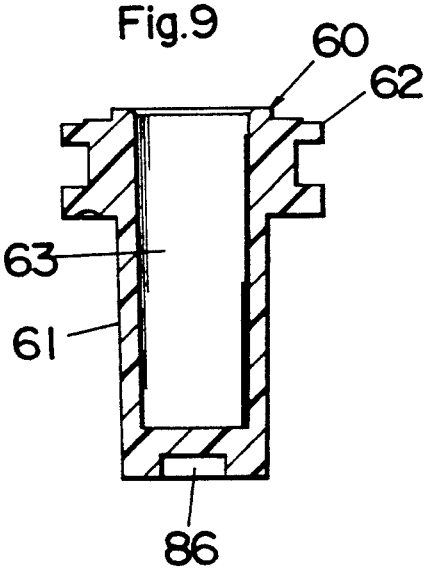
FIG. 9 is a vertical section taken along line B—B of FIG. 8.

Each of the hinge shafts 41 and 42 has its end connected to each of dashpots 50 disposed in a pair within a casing 11 surrounding the rear half of the bowl 10 and incorporating a device (not shown) capable of ejecting hot water for washing posterior parts. The dashpots 50 are provided to dampen the motion the toilet seat 20 and lid 30 moving from the raised position to the lowered position. As shown in FIG. 2, the dashpot 50 comprises a cylinder housing 51 containing a damper fluid 70 such as a grease or the like and a rotor 60 rotatable within the cylinder 51. The rotor 60 comprises an arbor 61 with an outwardly extending annular flange 62 at its axial end. The rotor 60 has also formed therein an I-shaped slot 63 extending axially into the arbor 61 and opened in the end face of the flange 62 for receiving the corresponding one of the hinge shafts 41 and 42 so that the rotor 60 is rotatable together with the corresponding hinge shaft and therefore with the toilet seat 20 or the lid 30. An O-ring 64 is fitted around the flange 62 to seal the opening of the cylinder 51. Integrally projecting into the interior of the cylinder 51 is a shelf 52 which is recessed from the opening to define a shoulder 53 on its upper end and which extends circumferentially over an angular range of more than 180° about a center axis of the cylinder 51 to define on the inside wall of the shelf 52 a bearing surface 54 upon which the arbor 61 of the rotor 60 is coaxially supported with a center post 85 on the bottom of the cylinder 50 fitted in a corresponding recess 86 in the bottom of the arbor 61, as shown in FIG. 7, so that the rotor 60 can rotate within the cylinder 51, as shown in FIG. 3. The damper fluid 70 is filled within a space which is defined between the circumferentially spaced end walls of the shelf 52 and which extends circumferentially about the arbor 61 over a limited angular range of less than 180° and extends axially the full length of the arbor 61. Projecting on the shoulder 53 are circumferentially spaced first and second balls 55 and 56 in rolling contact with the underside of the annular flange 62 of the rotor 60. These balls 55 and 56 are biased toward the flange 62 by individual springs 57 received in a slot 58 of the shelf 52, as shown in FIG. 7 (although only one spring 57 is shown for the ball 55). A seal plate 90 is provided to close the opening of the cylinder 51 around the flange 62 of the rotor 60 and is secured to the cylinder 51 by means of screws 91 engaging into mount holes 59 formed around the cylinder 51.

Also included in the dashpot 50 is a flap 80 which projects on the arbor 61 of the rotor 60 to extend into the damper fluid 70 along the full axial length of the arbor 61. The flap 80 is formed from a plastic material to have at its one end with an anchor bulb 81 which is received in a bearing cavity 65 formed in the outer surface of the arbor 61 so that the flap 80 is pivotably supported on the arbor 61 to pivot within a limited angular range between a folded condition where it lies down upon or is inclined with respect to the exterior of the arbor (as indicated by dotted lines in FIG. 3) and an unfolded condition where it projects radially (as indicated by solid lines in FIG. 3). The flap 80 has its other end portion bent at an angle of about 90° and at the same time made into a reduced thickness to define thereat a flexible tongue 82 for contact with the interior surface of the cylinder 51 without causing any substantial gap therebetween when the flap 80 is in the unfolded condition. Integrally projecting from the arbor 61 adjacent the bearing cavity 65 is a stopper 66 which backs up the flap 80 to prevent it from further pivoting beyond the unfolded condition. The flap 80 is also prevented from pivoting in the opposite direction beyond the folded position by engagement of the flap 80 adjacent the anchor bulb 81 with a somewhat triangular edge 84 of the bearing cavity 65 opposite of the stopper 66.

The flap 80 is caused to pivot from the folded condition to the unfolded condition in response to the toilet seat 20 and the lid 30 moves down from the raised position to the lowered position. That is, the pivot shaft 41 rotates together therewith in the counterclockwise direction in FIG. 3, during which the flap 80 receives an increased resisting force from the damper fluid 70 so as to dampen or slow the movement of the seat 20 and the lid 30. On the other hand, the flap 80 is caused to pivot from the unfolded condition to the folded position as the seat 20 and the lid 30 moves upward from the lowered position to the raised position. That is, the pivot shaft 41 rotates together therewith in the clockwise direction in FIG. 3, during which the flap 80 receives only a slight resisting force from the damper fluid 70 as the damper fluid 70 is allowed to freely flow through a gap formed between the interior surface of the cylinder 51 and the tongue 82 of the inclined flap 80. The two dashpots 50 are connected to each of the hinge shafts 41 and 42 such that one dashpot is responsible for dampening the motion of the seat 20 while the other is for the lid 30. Since the seat 20 and the lid 30 rotate in the same manner, the two dashpots 50 are made into a symmetrical configuration. However, the, details are illustrated only for one of the dashpots 50 for the purpose of simplicity.

During the movement of the seat 20 or the lid 30 from the lowered position to the raised position, the tongue 82 of the flap 80 is kept in contact with the interior surface of the cylinder 51 such that the damper fluid 70 is permitted to flow only through minute perforations in the flap 80 at a restricted rate and prevented from passing between the tongue 82 and the interior surface of the cylinder 51, thereby assuring to slow the movement of the seat 20 or the lid 30 at a well controlled manner. As the seat 20 or the lid 30 approaches its lowered position, the flap 80 acts to compress the damper fluid 70 to a greater extent against the end wall of the shelf 52 while only permitting the damper fluid 70 to flow through the minute perforations 83, thereby progressively increasing the resisting force acting on the flap 80 in order to move the seat 20 or the lid 30 at substantially a constant rate or decreasing rate in compensation for increased acceleration of the seat 20 or the lid 30 toward the lowered position under the effect of gravity. It is noted at this time that the flap 80 of the dashpot 50 connected to the lid 30 is designed to have a greater number of perforations 83 and/or to have the perforations 83 of greater diameter than that of the other dashpot 50 for the seat 20 in order to differentiate the dampening capability for the seat 20 and the lid 30 of differing weights so that the seat 20 and the lid 30 can rotates down to the lowered position at substantially an equal rate irrespective of the difference in weight.

When the seat 20 or the lid 30 comes into the raised position, the tongue 82 rides on a cam projection 84 integrally formed on the interior surface of the cylinder and extending partly in the axial direction. In this raised position, therefore, a clearance is made between the tongue 82 and the interior surface of the cylinder 51 at a portion spaced axially away from the cam projection 84. With the thus formed clearance, the damper fluid 70 is allowed to flow readily therethrough at the initial operation of the moving the seat 20 or the lid 30 from the raised position down to the lowered position, facilitating to manipulate it with a reduced force by the user.

Figure 11:
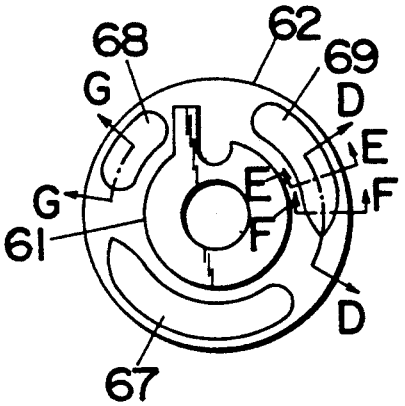
FIG. 11 is a bottom view of the rotor.

As shown in FIG. 11, the lower surface of the annular flange 62 with which the first and second balls 55 and 56 are in rolling contact is formed with three circumferentially spaced grooves 67 to 69 of different circumferential lengths. During the movement of the seat 20 or the lid 30 from the lowered position to the raised position, the first ball 55 moves relative to the flange 62 from within the first groove 67 into second groove 68, while the second ball 56 moves from within the third groove 69 into the first grooves 67.

Figure 12:
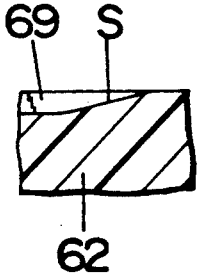
FIG. 12 is a sectional view taken along line D—D of FIG. 11.
Figure 13:
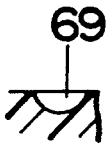
FIG. 13 is a sectional view taken along line E—E of FIG. 11.
Figure 14:
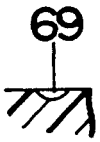
FIG. 14 is a sectional view taken along line F—F of FIG. 11.
Figure 15:
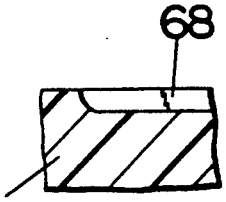
FIG. 15 is a sectional view taken along line G—G of FIG. 11.
Figure 16:
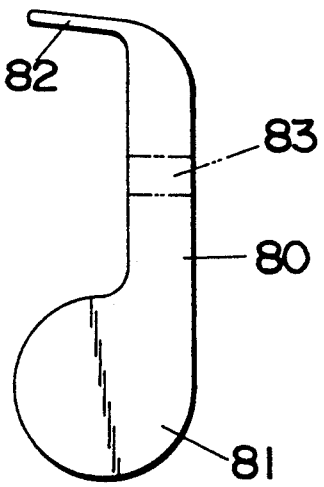
FIGS. 16 and 17 are top and side views of a flap supported to the rotor.
Figure 17:
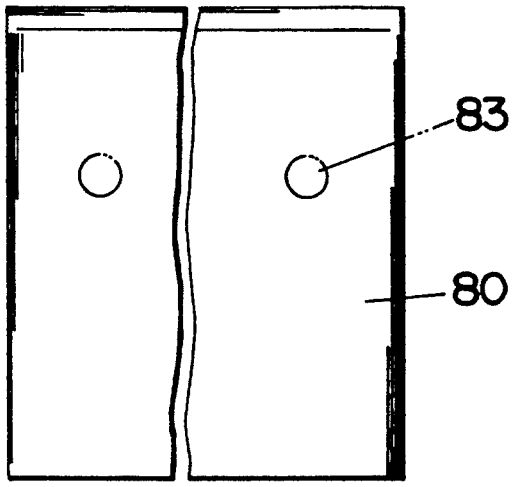
Figure 18:
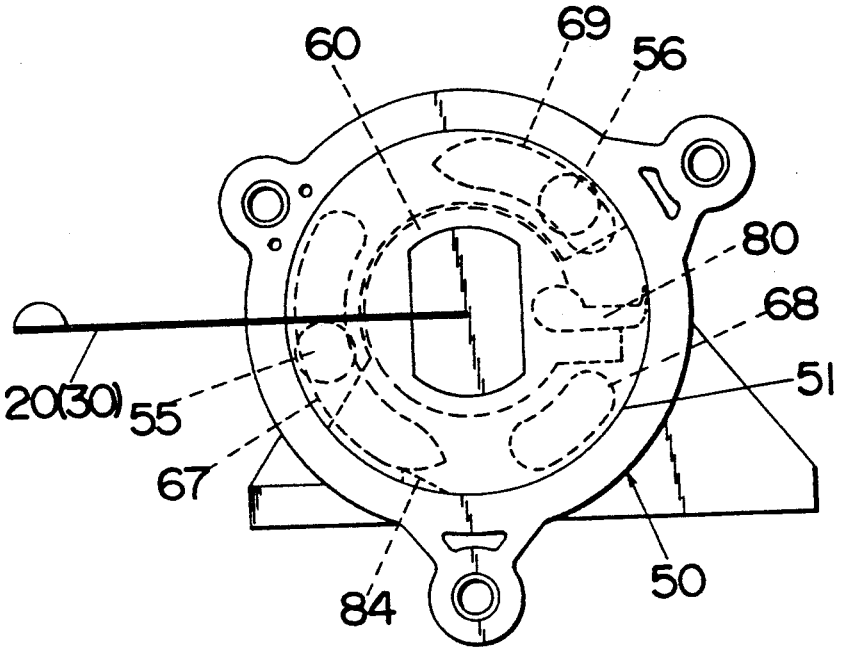
FIGS. 18 to 21 are respectively horizontal sections illustrating the operations of the dashpot during the movement of a toilet covering from a lowered position to a raised position.
Figure 19:
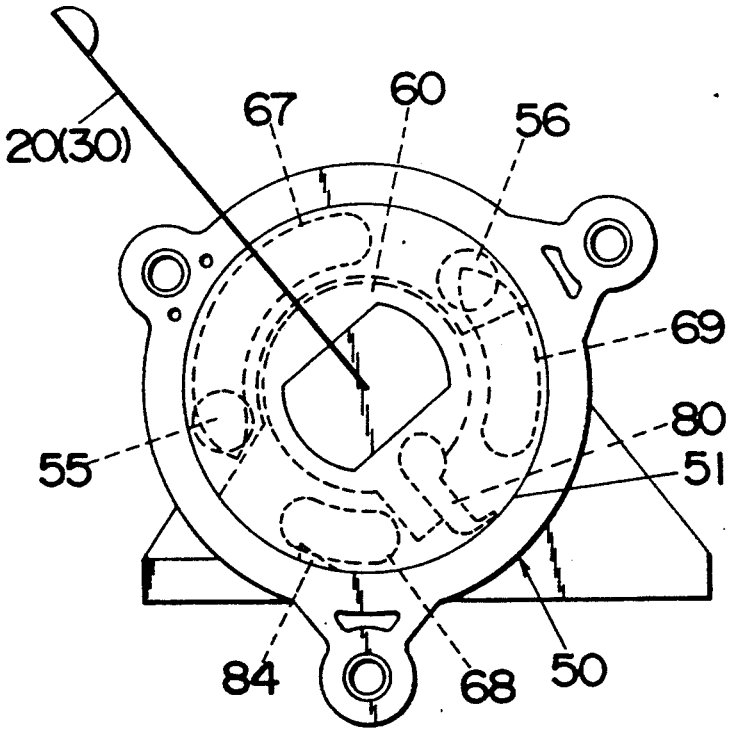
Figure 20:
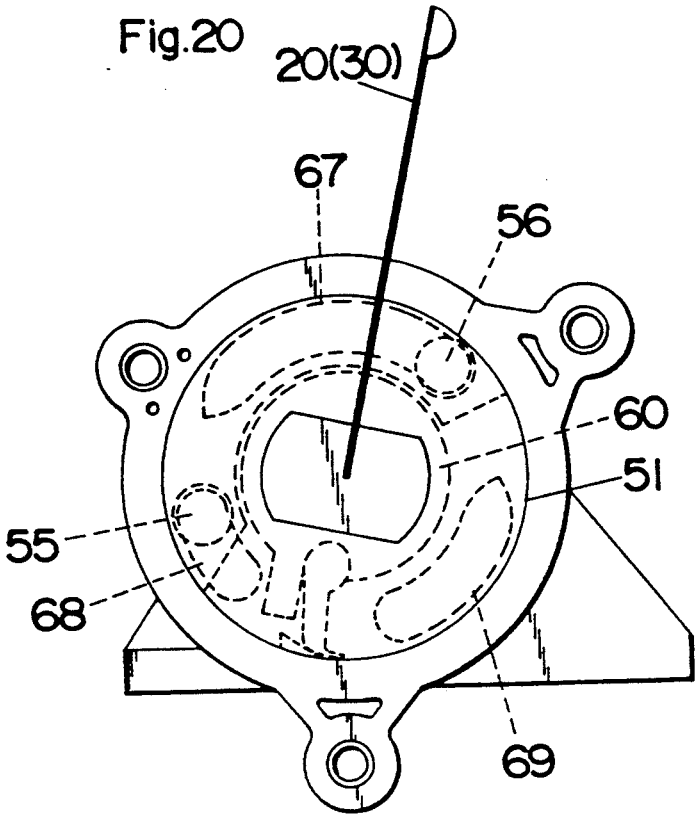
Figure 21:
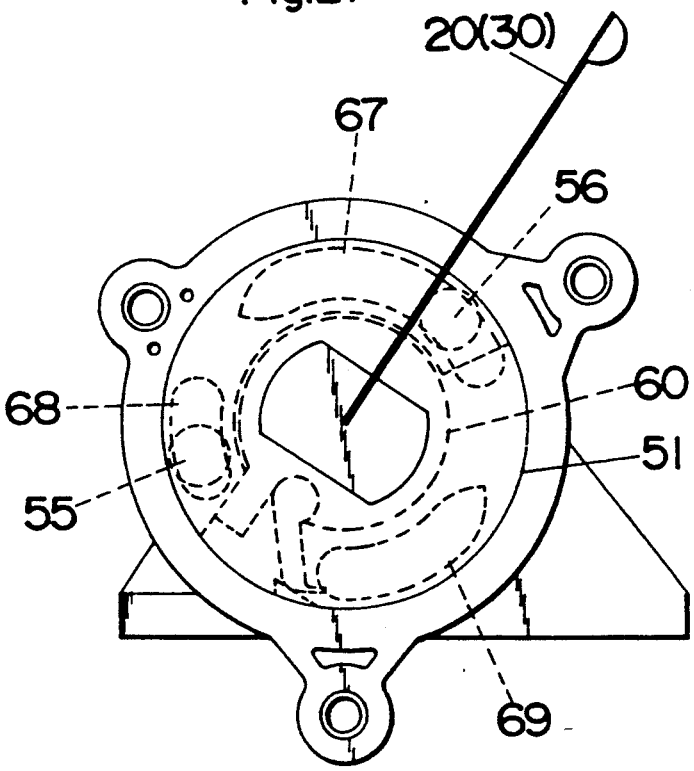
Figure 5:
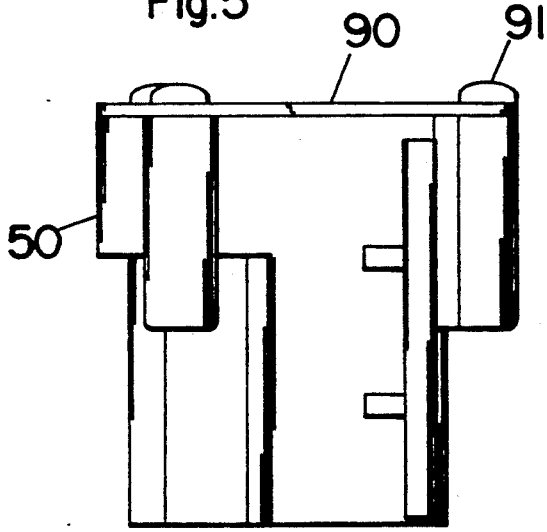
Figure 6:
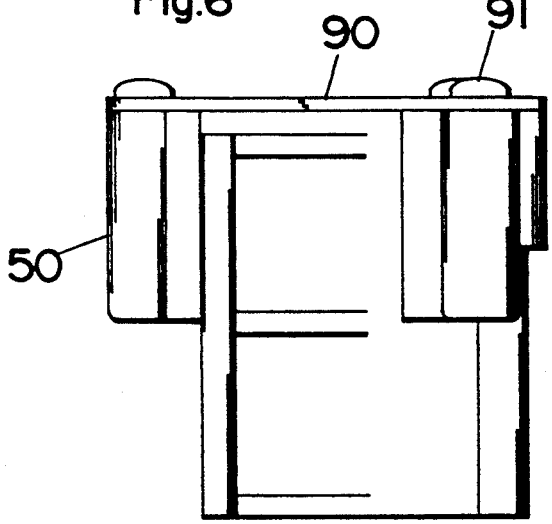
Figure 7:
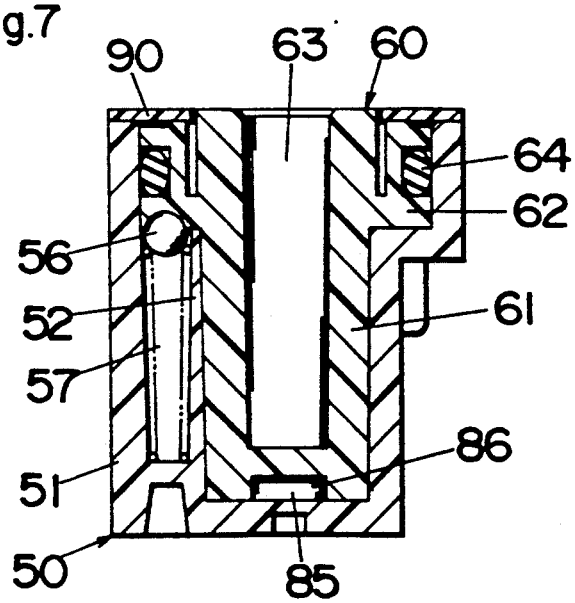

There are illustrated in FIGS. 18 to 21 the relative movement of the balls 55 and 56 to the grooves 67 to 69 as well as the position of the flap 80 in the cylinder 51 of the dashpot 50 when the seat 20 or the lid 30 rotates from the lowered position to the raised position. At the lowered position of FIG. 18, the first ball 55 and the second ball 56 are positioned respectively in the first and third grooves 67 and 69. As the seat 20 or the lid 30 rotates upwardly to an intermediate position of FIG. 19, the first and second balls 55 and 56 reach narrowed edges at respective ends of the first and third grooves 67 and 69. As shown in FIGS. 12 to 14, each of the edges at the ends of the first and third grooves 67 and 69 are formed to be continuous to the bottom of the main portion of the groove by way of a gradual slope S with a width smaller than the main portion toward the extreme end of the groove. Although only the narrowed edge for the third groove 69 is shown in FIGS. 12 to 14, the first groove 67 has the narrowed edge with the like slope. Therefore, the balls 55 and 56 can move readily out of the first and third grooves 67 and 69 such that the seat 20 or the lid 30 is permitted to further rotate from the position of FIG. 19 to a position of FIG. 20. At the position of FIG. 20, the balls 55 and 56 drop, after passing plateaus ahead of the first and third grooves 67 and 69, into the second groove 68 and the first groove 67, respectively. The balls 55 and 56 are kept retained in the second and first grooves 68 and 67 until the seat 20 or the lid 30 is finally rotated to the raised position of FIG. 21, thereby latching the seat 20 or the lid 30 in the raised position to prevent it from accidentally moving down to the lowered position. It is noted in this connection that the tongue 82 of the flap 80 starts riding on the cam projection 84 as the seat 20 or the lid 30 moves from the position of FIG. 20 to the final raised position of FIG. 21 and is spaced by a suitable clearance from the interior surface of the cylinder 51 at the position of FIG. 21 The flap 80 is shown in FIGS. 18 to 21 to be in its unfolded position as occurred in the motion of the seat 20 or the lid 30 rotating from the raised position of FIG. 21 down to the lowered position of FIG. 18.

The seat 20 or the lid 30 rotates from the raised position to the lowered position in the reverse order as explained in the above. During the movement from the position of FIG. 21 to that of FIG. 20, the seat 20 or the lid 30 can be, manipulated without requiring an extra application of force because the flap 80 receives no substantial resisting force from the damper fluid 70 as the fluid can freely pass through between the tongue 82 on the cam projection 84 and the interior surface of the cylinder 51 and that the balls 55 and 56 are limited to move, respectively, within the first and third grooves 67 and 69. Further rotating it downward past the position of FIG. 20 requires intentionally applying a rather strong force to the seat 20 or the lid 30 so as to move the balls 55 and 56 out of the first and third grooves 67 and 69, respectively, over rather steep edges at the other ends of the grooves. After moving to the position of FIG. 19 where the balls 55 and 56 enter the first and third grooves 67 and 69, the seat 20 or the lid 30 is allowed to rotate downward by its own weight at a dampened rate or slowly to the lowered position of FIG. 18. When it is desired to manipulate the seat 20 or the lid 30 from the position of FIG. 21 to the position of FIG. 20 with an application force of less intensity, or to manipulate it lightly during this movement, the cam projection 84 may be elongated in the circumferential direction, as shown in FIG. 22, to give an extended travel distance during which the damper fluid 70 is allowed to freely pass between the tongue 82 of the flap 80 and the interior surface of the cylinder 80 to greatly reduce the resisting force which the flap 80 experiences from the damper fluid 70. In the opposite sense, the cam projection 84 may be reduced in its circumferential direction to adjust the initial actuation force of moving the seat 20 or the lid 30 down from the raised position to the lowered position.

What is claimed is:

1. A hinge assembly with damping capability for mounting a toilet covering to the rear of a toilet for rotation of the toilet covering about a hinge axis between a lowered and a raised position, said hinge assembly comprising:

a hinge shaft adapted to be connected to the toilet covering to be rotatable together therewith about the hinge axis; and a dashpot adapted to be secured on the side of the toilet, said dashpot incorporating a cylinder containing a volume of damper fluid and a rotor rotatably received within said cylinder and connected to said hinge shaft to be rotatable together therewith, said rotor provided with a flap extending outwardly into said damper fluid and pivotable relative to said rotor such that said flap, in response to the toilet covering moving from the lowered position to the raised position, pivots into a folded condition where it receives no substantial resistance from said damper fluid and said flap, in response to the toilet covering moving from the raised position to the lowered position, pivots into an unfolded condition where it receives increased resistance from said damper fluid for dampening motion of the toilet covering, said flap being integrally formed at one end with an anchor bulb which is rotatably fitted within a corresponding bearing cavity formed in an outer surface of said rotor so that said flap is pivotable between the folded and unfolded conditions while said anchor bulb is retained within said bearing cavity.

2. A hinge assembly as set forth in claim 1, wherein said rotor is formed with a first stopper limiting pivotal movement of said flap so as to prevent it from further pivoting past the folded condition to lie down on an exterior surface of said rotor during the movement of the toilet covering from the lowered position to the raised position, and is formed with a second stopper projecting on said rotor to support said flap in the unfolded condition during movement of the toilet covering from the raised position to the lowered position.

3. A hinge assembly with damping capability for mounting a toilet covering to the rear of a toilet for rotation of the toilet covering about a hinge axis between a lowered and a raised position, said hinge assembly comprising:

a hinge shaft adapted to be connected to the toilet covering to be rotatable together therewith about the hinge axis; and a dashpot adapted to be secured on the side of the toilet, said dashpot incorporating a cylinder containing a volume of damper fluid and a rotor rotatably received within said cylinder and connected to said hinge shaft to be rotatable together therewith, said rotor provided with a flap extending outwardly into said damper fluid and pivotable relative to said rotor such that said flap, in response to the toilet covering moving from the lowered position to the raised position, pivots into a folded condition where it receives no substantial resistance from said damper fluid and said flap, in response to the toilet covering moving from the raised position to the lowered position, pivots into an unfolded condition where it receives increased resistance from said damper fluid for dampening the motion of the toilet covering, said flap being molded from a plastic material to have a free end portion in the form of a resilient tongue which is biased into contacting engagement with an interior surface of said cylinder and pivotable between the folded and unfolded conditions so as to allow flow of said damper fluid in said hinge assembly.

4. A hinge assembly with damping capability for mounting a toilet covering to the rear of a toilet for rotation of the toilet covering about a hinge axis between a lowered and a raised position, said hinge assembly comprising:

a hinge shaft adapted to be connected to the toilet covering to be rotatable together therewith about the hinge axis; and a dashpot adapted to be secured on the side of the toilet, said dashpot incorporating a cylinder containing a volume of damper fluid and a rotor rotatable received within said cylinder and connected to said hinge shaft to be rotatable together therewith, said rotor provided with a flap extending outwardly into said damper fluid and pivotable relative to said rotor such that said flap, in response to the toilet covering moving from the lowered position to the raised position, pivots into a folded condition where it receives no substantial resistance from said damper fluid and, in response to the toilet covering moving from the raised position to the lowered position, pivots into an unfolded condition where it receives increased resistance from said damper fluid for dampening the motion of the toilet covering, said cylinder and said rotor defining therebetween a fluid chamber extending over a limited angular range about the hinge axis for receiving said damper fluid such that said flap in the unfolded condition extends into said fluid chamber in such a manner as to divide said fluid chamber into two sections of which volumes are variable as said rotor rotates in response to the movement of the toilet covering between the lowered and raised position, said flap being formed to have a free end portion with a resilient tongue which is biased into contacting engagement with an interior surface of said cylinder and pivotable between the folded and unfolded conditions so as to allow flow of said damper fluid between the two sections of said fluid chamber.

5. A hinge assembly with damping capability for mounting a toilet seat and a toilet lid to the rear of a toilet for rotation of the toilet seat and lid about a hinge axis between a lowered and a raised position, said hinge assembly comprising:

a pair of hinge shafts adapted to be connected respectively to the toilet seat and lid to be rotatable together therewith about the hinge axis; and a pair of dashpots adapted to be secured on a side of the toilet and connected respectively to said hinge shafts, each of said dashpot incorporating a cylinder containing a volume of damper fluid and a rotor rotatably received within said cylinder and connected to said hinge shaft to be rotatable together therewith, said rotor provided with a flap extending outwardly into said damper fluid and pivotable relative to said rotor such that said flap, in response to the toilet covering or lid moving from the lowered position to the raised position, pivots into a folded condition where it receives no substantial resistance from said damper fluid and, in response to the toilet covering or lid moving from the raised position to the lowered position, pivots into an unfolded condition where it receives increased resistance from said damper fluid for dampening the motion of the toilet seat or lid, said flap of each dashpot formed with at least one through-hole permitting said damper fluid to flow therethrough for adjusting resistance which said flap receives from said damper fluid, one of said dashpots being configured to have the different number and/or location of said through-holes in said flap from that of the other dashpot so as to give different resistance to the motion of the toilet seat from that of the toilet lid.

6. A hinge assembly with damping capability for mounting a toilet seat and a toilet lid to the rear of a toilet for rotation of the toilet seat and lid about a hinge axis between a lowered and a raised position, said hinge assembly comprising:

a pair of hinge shafts adapted to be connected respectively to the toilet seat and lid to be rotatable together therewith about the hinge axis; and a pair of dashpots adapted to be secured on the side of the toilet and connected respectively to said hinge shafts, each of said dashpot incorporating a cylinder containing a volume of damper fluid and a rotor rotatably received within said cylinder and connected to said hinge shaft to be rotatable together therewith, said rotor provided with a flap extending outwardly into said damper fluid and pivotable relative to said rotor such that said flap, in response to the toilet covering or lid moving from the lowered position to the raised position, pivots into a folded condition where it receives no substantial resistance from said damper fluid and, in response to the toilet covering or lid moving from the raised position to the lowered position, pivots into an unfolded condition where it receives increased resistance from said damper fluid for dampening the motion of the toilet seat or lid, said dashpots containing the damper fluid of different viscosity so as to give different resistance to the motion of the toilet seat from that of the toilet lid.

7. A hinge assembly with damping capability for mounting a toilet covering to the rear of a toilet for rotation of the toilet covering about a hinge axis between a lowered and a raised position, said hinge assembly comprising:

a hinge shaft adapted to be connected to the toilet covering to be rotatable together therewith about the hinge axis; and a dashpot adapted to be secured on the side of the toilet, said dashpot incorporating a cylinder containing a volume of damper fluid and a rotor rotatably received within said cylinder and connected to said hinge shaft to be rotatable together therewith, said rotor provided with a flap extending outwardly into said damper fluid and pivotable relative to said rotor such that said flap, in response to the toilet covering moving from the lowered position to the raised position, pivots into a folded condition where it receives no substantial resistance from said damper fluid and, in response to the toilet covering moving from the raised position to the lowered position, pivots into an unfolded condition where it receives increased resistance from said damper fluid for dampening the motion of the toilet covering, said cylinder formed on its interior surface with a cam projection on which the free end of said flap in the unfolded condition rides when the toilet covering moves into the raised position, said cam projection engaging a portion of said flap so as to leave between the remaining portion of said flap and the interior surface of said cylinder a clearance through which said damper fluid is permitted to flow.

8. A hinge assembly with damping capability for mounting a toilet covering to the rear of a toilet for rotation of the toilet covering about a hinge axis between a lowered and a raised position, said hinge assembly comprising:

a hinge shaft adapted to be connected to the toilet covering to be rotatable together therewith about the hinge axis; and a dashpot adapted to be secured on the side of the toilet, said dashpot incorporating a cylinder containing a volume of damper fluid and a rotor rotatably received within said cylinder and connected to said hinge shaft to be rotatable together therewith, said rotor provided with a flap extending outwardly into said damper fluid and pivotable relative to said rotor such that said flap, in response to the toilet covering moving from the lowered position to the raised position, pivots into a folded condition where it receives no substantial resistance from said damper fluid and, in response to the toilet covering moving from the raised position to the lowered position, pivots into an unfolded condition where it receives increased resistance from said damper fluid for dampening the motion of the toilet covering, said rotor formed there around with an outer flange at one axial end spaced from said flap in an axial direction of said rotor, said cylinder including a ball which is in rolling contact with said outer flange, said ball being held with a spring into a stop recess in said outer flange when the toilet covering comes into the raised position for latching the toilet covering into that position.

9. A hinge assembly as set forth in claim 8, wherein said outer flange is formed to further include an arcuate guide recess along which said ball is guided as the toilet covering rotates from the lowered position to a position immediately ahead of the raised position, said guide recess formed at its one end adjacent to said stop recess with a moderately sloped edge so as to smoothly move the ball out of said guide recess into said stop recess.

* * * * *